US006457772B1

(12) United States Patent
Forston

(10) Patent No.: US 6,457,772 B1
(45) Date of Patent: Oct. 1, 2002

(54) FOOD AND BEVERAGE HOLDER

(76) Inventor: James A. Forston, 4989 N. Holt, #204, Fresno, CA (US) 93705

( * ) Notice: Subject to any disclaimer, the term of this patent is extended or adjusted under 35 U.S.C. 154(b) by 0 days.

(21) Appl. No.: 09/760,575

(22) Filed: Jan. 16, 2001

(51) Int. Cl.[7] ..... A47C 7/62

(52) U.S. Cl. ..... 297/188.14; 297/188.06; 297/188.04; 297/188.18; 297/188.2

(58) Field of Search ..... 297/188.14, 188.18, 297/188.01, 188.04, 188.06, 188.2

(56) References Cited

U.S. PATENT DOCUMENTS

| | | | | | |
|---|---|---|---|---|---|
| 2,649,270 | A | | 8/1953 | Franks | |
| 2,706,516 | A | * | 4/1955 | Nordmark | 297/188.06 |
| 2,807,315 | A | | 9/1957 | Manne | |
| 2,926,879 | A | | 3/1960 | Dietrich | |
| 3,233,858 | A | | 2/1966 | Benjamin | |
| 4,191,350 | A | | 3/1980 | Ormond | |
| 4,434,961 | A | | 3/1984 | Hoye | |
| 4,560,128 | A | * | 12/1985 | Willeby et al. | 297/188.9 X |
| 4,828,211 | A | | 5/1989 | McConnell et al. | |
| 4,861,102 | A | * | 8/1989 | Fuller | 297/188.2 X |
| 4,887,784 | A | | 12/1989 | Kayali | |
| 4,984,722 | A | | 1/1991 | Moore | |
| 5,014,956 | A | | 5/1991 | Kayali | |
| 5,139,222 | A | | 8/1992 | Korrey et al. | |
| 5,141,194 | A | | 8/1992 | Burgess et al. | |
| 5,167,392 | A | | 12/1992 | Henricksen | |
| 5,191,679 | A | | 3/1993 | Harper | |
| 5,280,870 | A | | 1/1994 | Chick et al. | |
| 5,302,000 | A | * | 4/1994 | Ayotte | 297/188.2 X |
| 5,320,406 | A | * | 6/1994 | North | 297/188.14 |
| 5,328,143 | A | | 7/1994 | Koorey et al. | |
| 5,342,009 | A | | 8/1994 | Lehner | |
| 5,356,107 | A | * | 10/1994 | Sinohuiz | 297/188.18 X |
| 5,395,085 | A | * | 3/1995 | Mann | 297/188.14 X |
| 5,421,638 | A | | 6/1995 | Ayotte et al. | |
| 5,533,782 | A | * | 7/1996 | Goldman | 297/188.2 X |
| 5,709,429 | A | * | 1/1998 | Bergin | 297/188.04 |
| 5,813,644 | A | * | 9/1998 | Bergin | 297/188.04 X |
| 5,865,412 | A | * | 2/1999 | Mason | 297/188.18 X |
| 6,279,798 | B1 | * | 8/2001 | Partch et al. | 297/188.2 X |

FOREIGN PATENT DOCUMENTS

| | | |
|---|---|---|
| GB | 2 029 346 A | 3/1980 |

* cited by examiner

*Primary Examiner*—Rodney B. White
(74) *Attorney, Agent, or Firm*—Richard A. Ryan

(57) ABSTRACT

A food and beverage holder for attachment to a generally vertical object such as a standard used with commonly available stadium seats. The holder has a vertical base member having a clamp member that attaches to the object without requiring modification or alteration of the object, such as would be required to penetrate the object with a bolt or other connector. A center receptacle having an opening in its upper end for receiving food or drinks attaches to the vertical base member by sliding on to the base member. An adhesive is used to fixedly attach the center receptacle to the base member. One or more side receptacles can be attached to the side ends of the center receptacle for holding additional food or drink products. The side receptacles slide onto the center receptacle and attach thereto using an adhesive.

22 Claims, 4 Drawing Sheets

FOOD AND BEVERAGE HOLDER

BACKGROUND OF THE INVENTION

A. Field of the Invention

The present invention relates generally to holders used to store food and beverage materials while a person is engaged in another activity, such as watching a sporting event or other stadium activity. In particular, this invention relates to holders used to store food and beverages that are suitable for use in places where there is not much room for such holders. Even more particularity, the present invention relates to such holders that are useful for mounting on the standard of a seat without protruding into the walkway aisle between rows of seats.

B. Background

Many people attend events, such as sporting games, concerts, automobile races and the like, that are held in stadiums, arenas and theaters and other performance facilities having multiple rows of seats. Although in the past the seating arrangements in these facilities often consisted of benches or open seating, the increased popularity in use of these facilities, particularly for professional sporting events, has led to significant improvements in seating arrangements. For instance, most of these performance facilities now utilize chair seats that are mounted on a seat standard for increased comfort and enjoyment of the activity taking place. These seats are typically formed in a plurality of rows emanating from the playing or performing surface upward on an inclined or stepped-up portion of the facility such that each row of seats further away from the field or performing surface is higher than the row in front of it in order to improve the viewing of those persons in the seats behind other rows. In between the rows are aisles for walking and placing one's feet. Generally, the seats used for these facilities are capable of having the bottom or seating portion folded up against the upright or back portion in order to permit safe ingress and egress through the aisles.

It is well known that persons attending sporting or other events at performance facilities such as stadiums and the like often desire to purchase food and beverages from the vendors at such facilities for consumption during the sporting or other event. A common problem arising from the purchase and subsequent consumption of food and beverages is where to place the food and drink while the person is watching the game or performance. People generally do not desire to constantly hold the food or beverage products in their hands, even if they are capable of holding such products, while the game or performance is taking place. Many persons enjoy showing emotion or enjoyment of the event taking place by utilizing their hands for clapping, waving or other activity. For younger persons, holding on to the drink or food product can be particularly difficult. Even if a person is capable of holding on to these products, the hot or cold nature of the food or beverage generally discourages the constant holding of the product.

As a result of the problems associated with holding on to the food and beverage products, they are typically placed on the floor below the seat, between the seats or in the aisle. An obvious problem with such placement of food and beverages is that persons moving in the aisle or even those sitting in their seats can and do tend to knock over these products. Besides wasting the money spent on the food or drink and causing frustration with having to either do without or go get new products, the spillage of the food or beverage creates a mess that is generally lived with for the duration of the sporting event or performance and which must be cleaned up by the facility cleaning crews after the sporting event or performance is over. Often the mess migrates from the person whose food or beverage product was spilled to the seating area of persons located nearby, including those in rows in front of where the product spilled. Naturally, this reduces the enjoyment of the activity for the person who loses their food or beverage product and those located nearby where the mess migrates and creates additional expense, in the form of clean-up costs, for the facility managers or owners.

Various food and beverage holders have been developed to provide a location for persons to place their food and drink products to eliminate the problems described above. Providing a food and beverage holder for use in stadiums, arenas, theaters and other such performance facilities requires a solution to the problem of holder placement without interfering with the spectators moving in and out of the rows of seats along the aisle. Any such holder must balance the convenience for the holder for the person using the holder with the need to avoid taking up space in the aisle. The preferred way of accomplishing this objective is to take advantage of the inclined nature of the seat backs in front of the aisle and the space created below the top of the seat and above the aisle floor. For safety and functional purposes, the horizontally projecting portion of the holder should not extend past the invisible vertical plane where the top edge of the seat leans backward so as to not project into the aisle behind the seat any further than the back of the seat. Many state, county or local ordinances require that there be a minimum distance between the lowered seat bottom of seats in the rearward aisle and the upright seat back of the seats in the forward aisle and that any projection on the seats in front not protrude into this minimum space. For instance, some ordinances (i.e., fire codes) require a minimum of twelve (12) inches for this clear space.

A number of patents have issued for food and beverage holders for use in performance facilities described above. For instance, U.S. Pat. No. 5,421,638 to Ayotte, et al. discloses a seat attachment for mounting to the seat brackets, used to support the seat backs, which extend from the standard of a stadium seat. The device has a cup holder and a pair of arms extending from the cup holder that attach to the standard utilizing the bolts used to mount the seat backs to the brackets. The device is installed by removing the seat back bolts, placing the attachment against the standard and then re-inserting the bolts back into the seat backs through the brackets. While this patent does provide a cup holder useful for stadium seats, the installation of the attachment appears to be difficult due to the number and location of bolts to be removed and then reinstalled. U.S. Pat. No. 4,466,659 to Carpentier, et al. discloses a tray holder for holding food and beverages which attaches to the back of stadium seats using a belt and clamps. This device folds up to permit access through the aisle when not in use. Both the attachment mechanism and the structural configuration of this patent are considerably different than the present invention.

Other patents also show that it is known to connect a food and/or beverage holder to a stadium-type of seat. For instance, U.S. Pat. No. 2,932,544 to Lambert, U.S. Pat. No. 3,042,467 to Germick and U.S. Pat. No. 2,817,566 to Herman disclose other type of fold-up trays which attach to the backs or arms of seats. The attachment mechanism disclosed in these patents and the manner of folding and supporting the projecting tray are considerably different than the present invention. U.S. Pat. No. 1,893,458 to Tatum, U.S. Pat. No. 4,668,010 to Fujiwara, U.S. Pat. No. 2,278,014 to Olivant and U.S. Pat. No. 3,773,381 to Brenna disclose food and/or beverage holders that attach to the back of a seat. The structure of these patents are considerably different than the present invention. A related patent, U.S. Pat. No. 2,807,315 to Manne, discloses that it is known to mount a holder (in this instance a book holder) to the standard between the seats using a pair of "clips" bolted onto the standard. This invention requires a hole to be drilled through the standard for insertion of the bolt for the clips. As such, it differs from the present invention.

The existing art, both individually and in all appropriate combinations, show that the broad concept of providing a food and beverage holder suitable for attachment to a stadium seat or standard is well known. On the other hand, none of the known references show an easy to mount food/beverage holder that is suitable for use in stadium seating without interfering with ingress and egress through the aisles between the seats. What is needed is a convenient food and beverage holder that is adaptable for installation in stadiums and the like that is easy to install, does not require modifications to existing seating equipment and which does not project so far into the aisle as to present a problem with ingress and egress through the aisle.

SUMMARY OF THE INVENTION

The food and beverage holder of the present invention provides the benefits and solves the problems identified above. Specifically, the present invention discloses a relatively easy to install food and beverage holder for attachment to seat standards commonly used in stadium and other performance facilities. The holder of the present invention provides a convenient place for the person utilizing such facilities to place his or her food and drink products without causing ingress and egress problems for persons moving through the aisle. The holder of the present invention should substantially reduce the number of spills that result from persons moving through the aisles or shuffling their feet while sitting. This will reduce the spilling of food and beverage products and the cost of cleaning up messes resulting from such spills.

The present invention primarily comprises a center receptacle having an upper end, a lower end, a front side, a back side and a pair of opposing side ends. The upper end has a first opening for receiving one or more food or beverage products in the center receptacle. A generally vertical base member is attached to the back side of the center receptacle and a clamp member is attached to the base member. The clamp member has a pair of gripping arms extending rearwardly from the base member and one or more connectors interconnecting the pair of griping arms to connect the food and beverage holder to the object to which it is to be mounted (i.e., the standard used with stadium seats) without requiring the connectors to penetrate or alter the object. In the preferred embodiment, the holder has a side receptacle attached to at least one of the opposing side ends of the center receptacle. Like the center receptacle, the side receptacle has an upper end, a lower end, a front side, a back side and a pair of opposing side ends. The upper end has a second opening for receiving one or more food or beverage products in the side receptacle.

In the preferred embodiment, which utilizes a pair of side receptacles attached to the center receptacle, the side ends of the center receptacle have side receiving components configured into the center receptacle to slidably receive a center insert that is located on the side receptacle. An adhesive is used to fixedly attach the center insert of the side receptacle to the side receiving component of the center receptacle. The front sides of the center and side receptacles are adaptable for displaying visible promotional materials thereon. The bottom ends of the center and side receptacles have an opening to allow the drainage of fluid, such as rain, soda or wash fluid, therefrom.

In installing the holder of the present invention, the clamping member is attached the base member and then to the object on which the holder will be used with the connectors that also tightly close the gripping arms. An adhesive material is then sprayed onto the base member. The center receptacle is then slid upward onto the base member until a stop member on the base member prevents further upward movement of the center receptacle. An adhesive spray is then applied to the sides of the center receptacle and/or the side receptacle itself. Then the side receptacles are slid onto the center receptacle. The adhesive used for installing the holder should allow the receptacles to slide and then set in place to form a single holder unit. The receptacles and the final unit should be sized and configured to not extend into the aisle behind the row of seats to which the holder is being attached. In this manner, the holder of the present invention provides a place for those attending events held at a stadium, arena, theater or the like to safely and conveniently hold their food and beverages while they watch the event taking place.

Accordingly, the primary objective of the present invention is to provide a food and beverage holder that attaches to seat standards to effectively hold food and beverage products so they do not interfere with movement of persons through the aisles between the rows of seats.

It is also an important objective of the present invention to provide a food and beverage holder that is easy to install on seat standards utilized in stadiums, arenas, theaters and the like without requiring modification or alteration of the seats or seat standards.

It is also an important objective of the present invention to provide a food and beverage holder that has one or more compartments for holding food and/or beverages attached to a base member having an attachment mechanism for attachment to the typical seat standards utilized in stadiums, arenas, theaters and the like.

It is also an important objective of the present invention to provide a food and beverage holder that can be manufactured in separate components for easy packaging and shipping, but which permits quick assembly that is adaptable for installation on either ends of a row of seats.

The above and other objectives of the present invention will be explained in greater detail by reference to the figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention:

FIG. 4 is a back perspective view looking down at the base member of the present invention attached to a typical seat standard utilized in stadiums, arenas, theaters and the like.

DETAILED DESCRIPTION OF THE PREFERRED EMBODIMENTS

With reference to the figures where like elements have been given like numerical designations to facilitate the reader's understanding of the present invention, and particularly with reference to the embodiment of the present invention illustrated in FIGS. 1 through 5, the preferred embodiment of the present invention is set forth below. The enclosed figures and drawings are merely illustrative of the preferred embodiments and represent several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
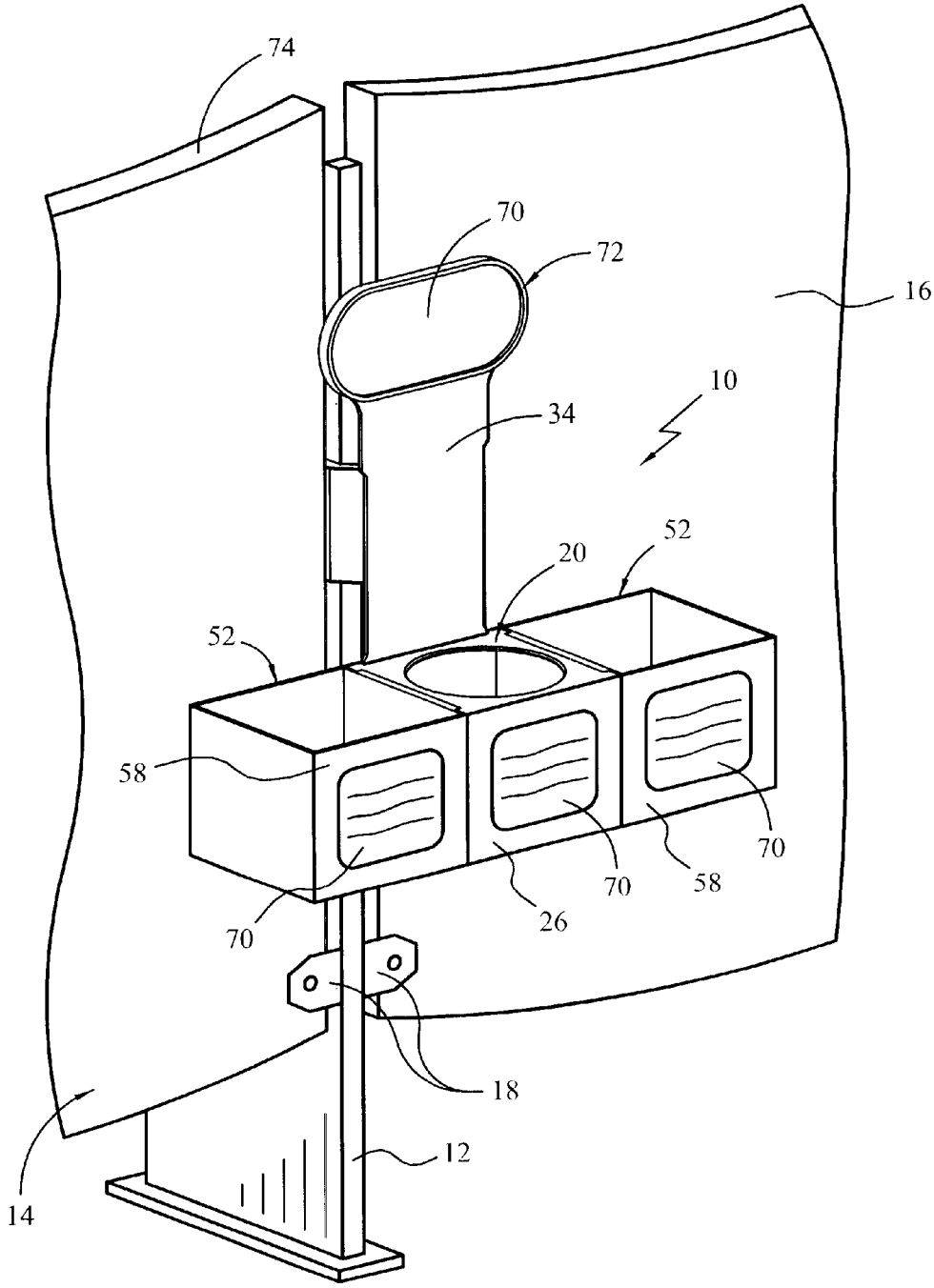
FIG. 1 is a perspective view of portions of a pair of seats having the food and beverage holder of the present invention mounted therebetween.

The food and beverage holder of the present invention, shown generally as 10, is shown in FIG. 1 attached to a standard 12 of seats 14. The upright backs 16 of seats 14 attach to standard 12 with seat brackets 18, which extend from standard 12 to support seats 14. Typically, the standard 12 and seat brackets 18 are fabricated from metal, such as steel, aluminum or cast iron. The seats 14 can be made from a variety of non-stick, non-heat absorbing materials such as fiberglass and other composite materials. The standard 12 and seat 14 combination shown in FIG. 1 is somewhat typical of seats which are utilized in stadiums, arenas, theaters and the like. In the usual configuration, seats 14 are in a plurality of rows emanating upward from the playing field, playing surface or performance area. Most often, the seats are of the type where the seat bottom (not shown) folds up, automatically or otherwise, out of the way when not in use to clear space for walking in the aisle separating rows of seats 14. Most local fire codes or other ordinances require the performance facility to maintain a minimum safe distance between the lowered seat bottom and the seat back 16 in the row in front in order to allow safe ingress and egress for persons sitting in the aisles.

The food and beverage holder 10 of the present invention has a center receptacle 20 having an upper end 22, lower end 24, front side 26, back side 28 and a pair of opposing side ends 30, as best shown in FIG. 1. The upper end 22 of center receptacle 20 has a first opening 32 therein for receiving one or more food or beverage products, such as a paper cup/container filled with soda, into center receptacle 20. First opening 32 should be sized and configured to receive the standard or large sized drinking cups served at most stadiums and other performance facilities. As shown in FIG. 1, the preferred configuration for first opening 32 is circular, to best fit standard or large sized drinking cups. Other shapes, however, will also function to receive most food and/or drink products. For instance, first opening 32 can be square, rectangle, oval, octagon or a variety of other shapes depending on the desired function for holder 12. The depth of center receptacle 20, i.e., the distance from the upper end 22 to the lower end 24, should be deep enough to provide sufficient room for the food or beverage products to stand up in center receptacle 20 without undue risk of falling or tipping over. The inventor has found that a depth of 2½ to 4 inches is typically sufficient. The bottom of center receptacle 20 can have one or more holes therein to allow water (i.e., rain, cleaning rinse, spilled drink, etc.) to drain from inside center receptacle 20.

Figure 2:
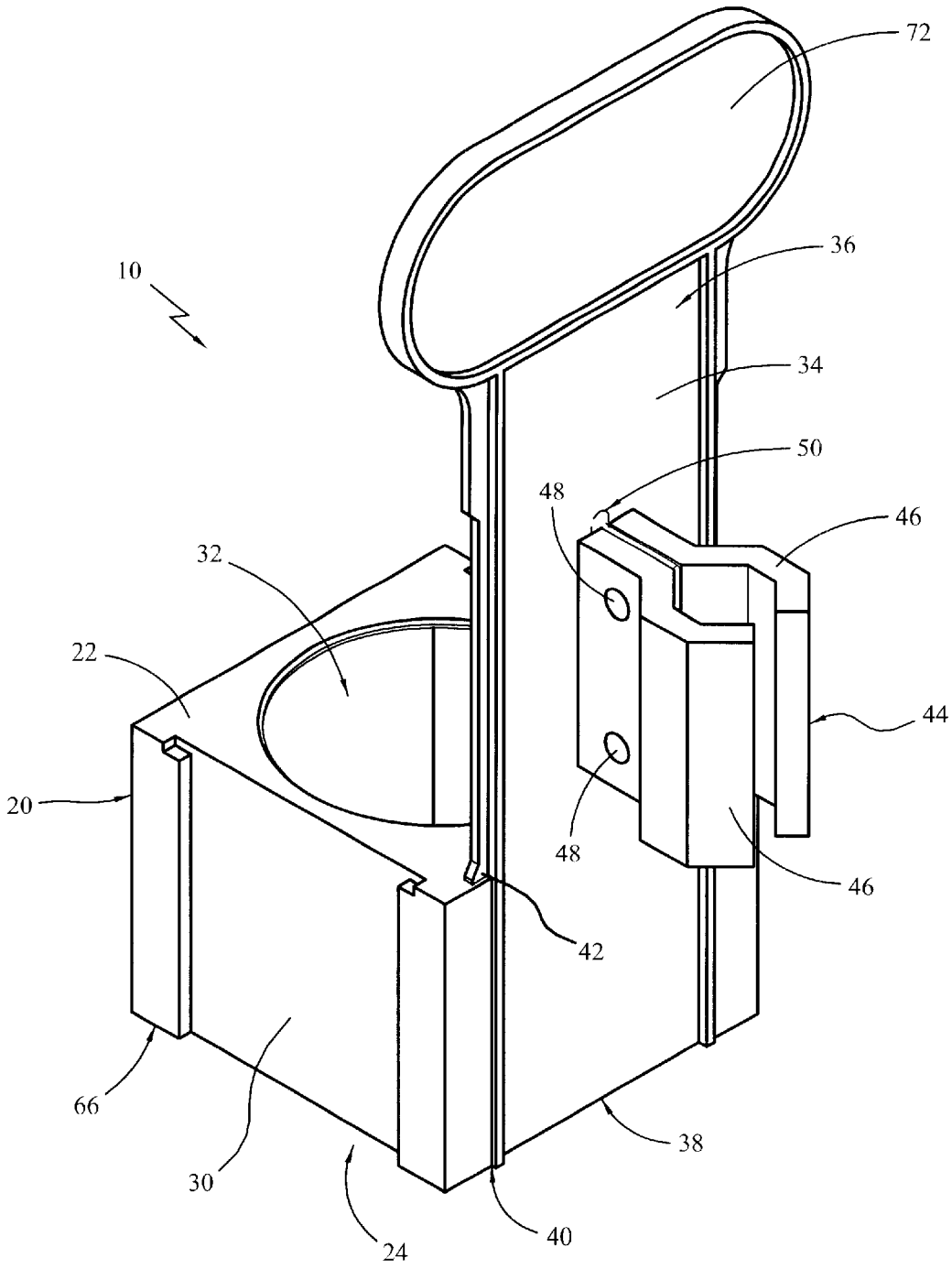
FIG. 2 is a back perspective view of the center receptacle of the food and beverage holder of the present invention.
Figure 3:
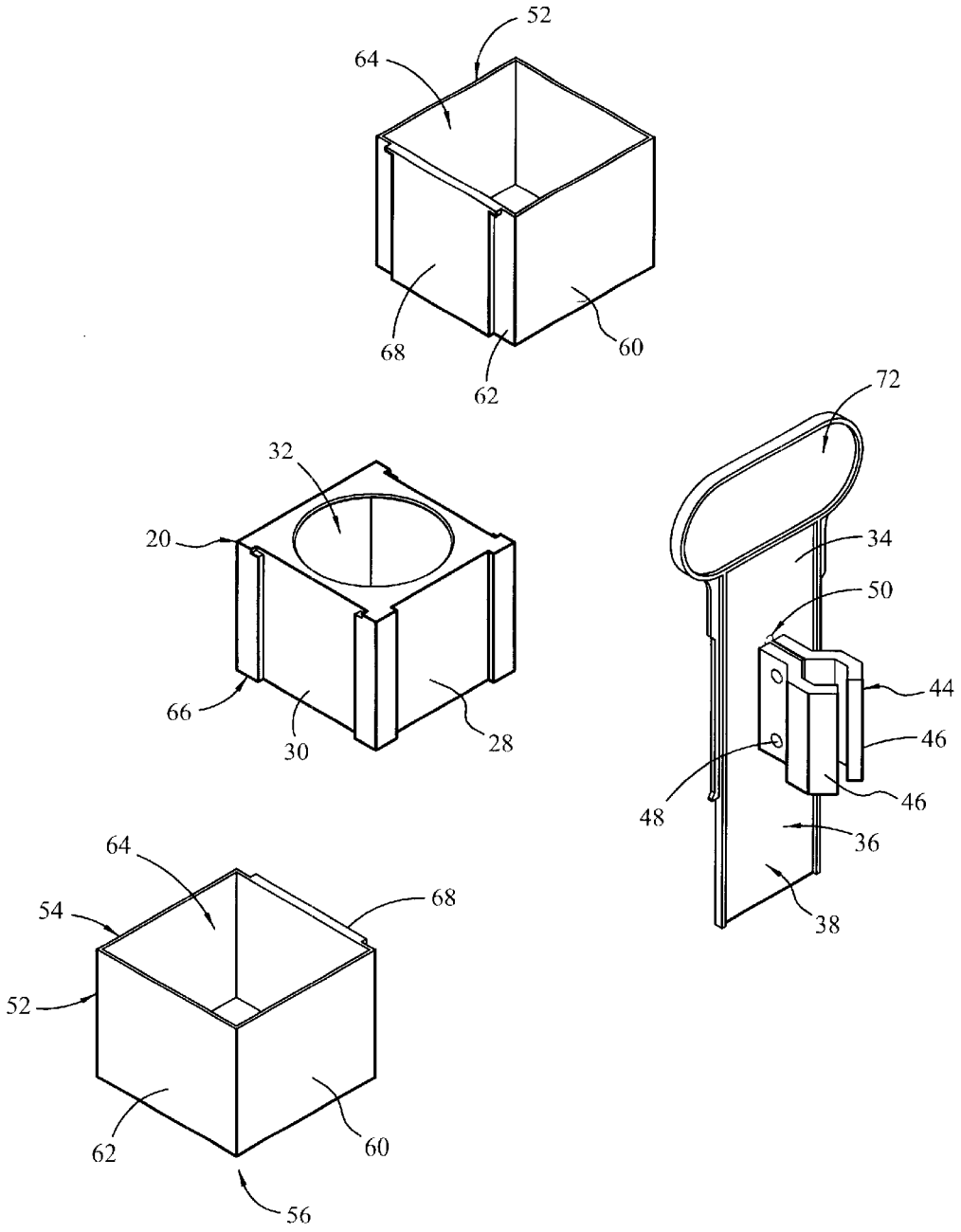
FIG. 3 is a back exploded view of the food and beverage holder of the present invention.
Figure 4:
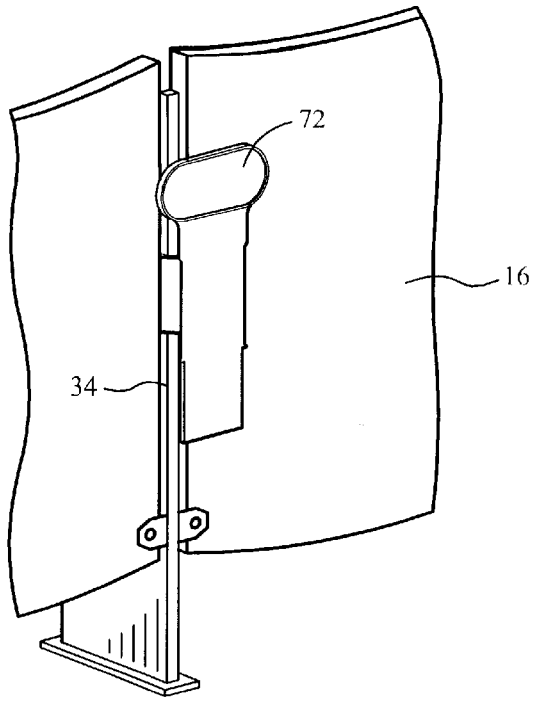

As best shown in FIGS. 1 through 3, attached to center receptacle 20 is a generally vertical base member 34 that has an upper end 36 and a lower end 38. Base member 34 can be molded integral with center receptacle 20, permanently affixed to thereto during the manufacturing process, or, as in the preferred embodiment, be a separate component that is configured to slidably receive center receptacle 20. To facilitate center receptacle 20 sliding on base member 34, center receptacle can include a shaped base receiving component 40 at the back side 28, as best shown in FIG. 3. In the preferred embodiment, center receptacle 20 slides onto base member 34 from the lower end 38 of base member 34. For ease in obtaining the correct positioning for center receptacle 20, base member 34 can include a stop member 42 that prevents center receptacle 20 from sliding any further up base member 34. In the preferred embodiment, an adhesive is applied to base member 34 in the area where center receptacle 20 is to be located (i.e., below stop member 42). The adhesive should be of the type that allows center receptacle 20 to easily slide into position prior to setting. The width of base member 34 at its lower end 38 and the width of base receiving component 40 should be such that base receiving component 40 tightly receives lower end 38 therein. In this manner, center receptacle 20 will stay on base member 34 until the adhesive has a chance to completely set.

Figure 5:
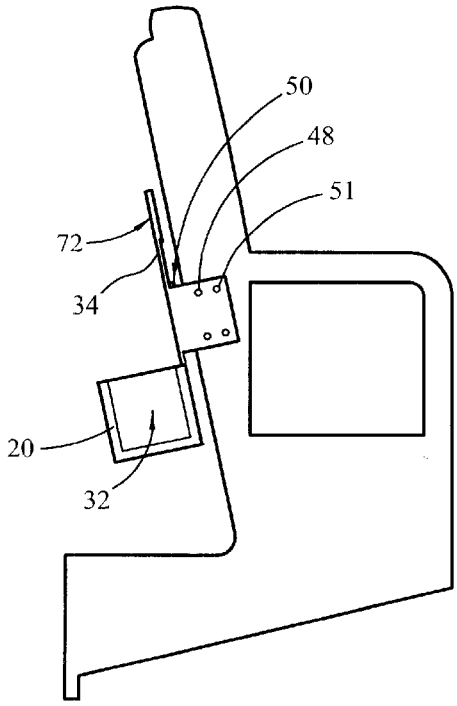
FIG. 5 is a side perspective view showing the present invention attached to a seat standard.

As shown in FIGS. 1 through 3, base member 34 has a clamp member 44 attached thereto. Clamp member 44 has a pair of gripping arms 46 extending outwardly from base member 34. One or more connectors 48, such as bolts, screws, rivets and other types of connectors interconnect the gripping arms 46 to clamp arms 46 together around the object to which the food and beverage holder 10 of the present invention is intended to connect (i.e., the standard 12 as shown in FIG. 1) without requiring penetration or alteration of the object to which holder 10 is to connect. In the preferred embodiment, as best shown in FIG. 3, connectors 48 also connect gripping arms 46 to an extender 50 protruding from base member 34 and disposed between gripping arms 46. Gripping arms 46 should be designed and configured to tightly grip the object, such as standard 12, for which the food and beverage holder 10 is intended when connectors 48 are tightened (i.e., bolts or screws) or installed (i.e., rivets). The ends of gripping arms 46 can extend outward, as shown in FIG. 5, and have one or more holes 51 therein for insertion a bolt or screw through the hole 51 and into or through the seat standard 12. In most instances, it will be necessary to drill one or more holes in the seat standard 12.

Although the present invention 10 can be used as described above, to improve its functionality it should include a side receptacle 52 attached to center receptacle 20. As shown in FIG. 1, the preferred embodiment includes the use of a pair of side receptacles 52, one each of receptacles 52 attached to sides 30 of center receptacle 20. As with the center receptacle 20, side receptacles 52 have an upper end 54, lower end 56, front side 58, back side 60 and a pair of opposing side ends 62, as best shown in FIGS. 1 and 3. Upper end 54 of side receptacle 52 has a second opening 64 therein for receiving one or more food or beverage products, such as a paper cup/container filled with soda, bags of french fries or peanuts, into side receptacle 52. Second opening 64 should be sized and configured to receive french fries, hot dogs or hamburgers that are sold at most stadiums and other performance facilities and/or any of the various other food products sold at the facilities. As shown in FIGS. 1 and 3, the preferred configuration for second opening 64 is a generally square shape, to better accept a variety of food products. Other shapes, however, will also function to receive most food and/or drink products. For instance, second opening 64 can be circular, rectangle, oval, octagon or a variety of other shapes depending on the desired function for holder 12. The depth of side receptacle 52, i.e., the distance from the upper end 54 to the lower end 56, should be deep enough to provide sufficient room for the food or beverage products to stand up in side receptacle 52 without undue risk of falling or tipping over. For instance, a depth of 2½ to 4 inches, the same as for center receptacle 20, is typically sufficient. The bottom of side receptacle 52 can have one or more holes therein to allow water (i.e., rain, cleaning rinse, spilled drink, etc.) to drain from inside side receptacle 52.

Side member(s) 52 can be molded integral with center receptacle 20, permanently affixed to thereto during the manufacturing process, or, as in the preferred embodiment, be made as a separate component that is configured to slide onto center receptacle 20. One reason to manufacture the holder 10 of the present invention with slide-on side receptacles 52 is to allow one set of holders 10 to be made without having to design or manufacture around the problems created by the end of the rows of seats. If side receptacles 52 were manufactured to be fixedly attached to center receptacle 20, then at the ends of the rows a side receptacle 52 would protrude into the walkway going up and down the aisles, thereby creating the potential of someone tripping over holder 10. To avoid this problem, a certain number of holders 10 would have to be manufactured as only having either a left or right side receptacle 52, depending on which end of the row holder 10 is to be placed. By allowing the installer to choose which side of center receptacle 20 to place a side receptacle 52 on, the use of slide-on side receptacles 52 avoids both of the problems described above.

To facilitate side receptacle 52 sliding on center receptacle 20, center receptacle 20 can include shaped side receiving component 66 on its side end 30, as best shown in FIG. 1, and side receptacle 52 can include center insert 68 on one of its side end 62, as shown in FIG. 3. In the preferred embodiment, the center insert 68 of side receptacle 52 slides into side receiving component 66 of center receptacle 20. In the preferred embodiment, an adhesive is applied to either or both side ends 30 of center receptacle 20 or side end 62 of side receptacle 52. The adhesive should be of the type that allows side receptacle 52 to easily slide into position prior to setting. The width of center insert 68 and the width of side receiving component 66 should be such that side receiving component 66 tightly receives center insert 68 therein. In this manner, side receptacle 52 will stay on center receptacle 20 until the adhesive has a chance to completely set. Once set, center receptacle 20 and side receptacle(s) 52 form a complete food and beverage holder 10.

The food and beverage holder 10 of the present invention described above can include some variations to improve its usefulness and versatility. For instance, as shown in FIG. 1, first opening 32 in center receptacle can be sized and configured to be different than second openings 64 in side receptacles 52 to facilitate placement of different types of items (i.e., food versus drinks) therein. Of course the configuration, circle versus square, can be swapped between first 32 and second 64 openings. In addition, first opening 32 can be the same as second openings 64. Because many of the uses for holder 10 may be outside where it will be exposed to the weather, center receptacle 20 and/or side receptacles 52 can have a variety of openings therein to facilitate drainage of soda, rain or other fluids that may have a tendency to fill these receptacles. The openings can comprise one or more openings on the bottom ends 24 or 56 or the bottom ends 24 or 56 can comprise a grate-like configuration that prevents fluid from building-up inside the receptacles 20 and 52. In addition, it is not necessary that the sides 30 and 62 of the center 20 and side 52 receptacles, respectively, be solid. The sides 30 and 62 can be open to allow air to pass through and to facilitate easy cleaning of the receptacles (i.e., with a hose or other spray device). Although the front sides 26 or 58 can also be open, there are some benefits to providing these in a solid form, as described below.

The food and beverage holder 10 of the present invention can be manufactured from a variety of materials. Although various plastics, lightweight metals, composites or other materials may be suitable for holder 10, the inventor has found that the use of Lexan®, a polyethylene material, works well for the center receptacle 20, base member 34, side receptacles 52 and extender 50, whereas a polyethylene material reinforced with fibers, such as nylon or other materials, works well for the clamp member 44. As discussed below, the material chosen for center receptacle 20 and side receptacles 52 should permit the ability to mold in or stick on promotional materials for holder 10. The use of reinforced polyethylene provides a more durable, temperature resistant material that helps gripping arms 46 grip the object to which holder 10 is to be attached. Various adhesive, as commonly known and available in the art, can be utilized for attaching center receptacle 20 to base member 34 and side receptacles 52 to center receptacle 20. As set forth below, the use of a spray-on adhesive makes installation of holder 10 easier and faster.

To obtain additional benefits from holder 10, a variety of visual promotional materials, shown as 70 in FIG. 1, can be displayed on the front sides 26 and 58 of center receptacle 20 and side receptacles 52, respectively. The owner or managers of the performance facility (i.e., stadium) can make a financial arrangement with a corporate sponsor to place the corporation's logo and/or advertising slogan on the front ends 26 and 58 of holder 10. In this manner, the persons who are attending the sporting or other event being held at the facility will be exposed to the corporate advertising for the duration of the event. Alternatively, the promotional material could comprise sayings or slogans supporting the local team or a variety of charitable, religious or political groups. If desired, the promotional display can be changed to reflect different sponsors for different events. To further facilitate the use of promotional materials, base member 34 can include an upper portion 72 disposed at its upper end 36 that can be used to display visual promotional material, as shown in FIG. 1. Alternatively, the manufacture of holder 10 can display its trademark or corporate logo on upper portion 72 or elsewhere on holder 10.

In use, holder 10 can be installed on any type of object, preferably it would be a generally vertical object, suitable for accepting clamping member 44. To install holder 10, the installer would first loosely attach clamping member 44 to extender 50 on base member 34, if not a single unit, using connectors 48. Then the installer would spread apart gripping arms 46 to fit around the object (i.e., seat standards 12 as used at stadiums). By tightening or otherwise applying connectors 48, the base member 34 becomes attached to the object. The base member 34 should be placed at the appropriate height on the object to accomplish the objectives of holder 10. For instance, for use in stadiums holder 10 should be placed sufficiently low on the standard 12 (relative to the top 74 of seat 14) such that it does not extend past the vertical plane at the edge of the seat back 16 created from seat back 16 tilting backward slightly into the aisle behind seat 14. In this manner, holder 10 will not protrude into the aisle and will not result in any violations of state, county or city ordinances. The inventor has found that a holder having a center receptacle 20 and side receptacles 52 that protrude forward from base member 34 no more than approximately 4 to 6 inches will not interfere with the ingress and egress of most aisles in stadium seating. Some stadiums may allow increased size and some may require less, depending on the controlling ordinances and the amount the seats tilt-back into the row behind. The width of center receptacle 20 and side receptacle 52 can be selected for what is appropriate for the types of food and beverages available at the subject facility. The inventor has found that receptacles 20 and 52 being approximately 4 inches is fairly typical of what would be required. To fit onto most standards used for stadium seating, the inventor has found that a clamping member 44 that clamps down to approximately 1/16 of an inch is typically sufficient.

Although the present invention has been discussed and shown in terms of its use with stadium-type seating, it is not so limited. The gripping arms of clamp member of the present invention 10 is suitable for fixedly gripping a number of different generally upright objects. For instance, clamp member can be attached to a vertical post, leg or bar for use by the pool or other locations. In addition, the present invention 10 may be adapted for use inside a motor vehicle, such as a car or truck.

While there is shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use.

What is claimed is:

1. A food and beverage holder for mounting onto a generally upright object, comprising:

a center receptacle having an upper end, a lower end, a front side, a back side and a pair of opposing side ends, said upper end having a first opening for receiving one or more food or beverage products in said center receptacle, at least one of said side ends of said center receptacle having a side receiving component;

a side receptacle having a pair of opposing side ends and a center insert located on at least one of said side ends, said center insert slidably received in said side receiving component of said center receptacle, said side receptacle having a second opening for receiving one or more food or beverage products in said side receptacle;

a generally vertical base member attached to said back side of said center receptacle;

a clamp member attached to said base member, said clamp member comprising a pair of gripping arms extending rearwardly from said base member; and one or more connectors interconnecting said pair of gripping arms for connecting said food and beverage holder to the object without requiring said one or more connectors to penetrate or alter the object.

2. The holder according to claim 1, wherein an adhesive is used to fixedly attach said center insert of said side receptacle to said side receiving component of said center receptacle.

3. The holder according to claim 1, wherein said side receptacle has an upper end, a lower end, a front side, a back side and a pair of opposing side ends, said second opening disposed in said upper end.

4. The holder according to claim 3, wherein said front side of said side receptacle is adaptable for displaying visible promotional materials thereon.

5. The holder according to claim 3 further comprising a pair of side receptacles, one of said pair of side receptacles attached to each of said opposing side ends of said center receptacle.

6. The holder according to claim 3, wherein said bottom side of said side receptacle has an opening to allow the drainage of fluid therefrom.

7. The holder according to claim 1, wherein said center receptacle can slide upward onto said base member.

8. The holder according to claim 7 further comprising a stop member on said base member, said base member configured to stop the further upward movement of said center receptacle.

9. The holder according to claim 1, wherein said bottom side of said center receptacle has an opening to allow the drainage of fluid therefrom.

10. The holder according to claim 1, wherein said base member has an upper portion adaptable for displaying visible promotional materials thereon.

11. The holder according to claim 1, wherein said front side of said center receptacle is adaptable for displaying visible promotional materials thereon.

12. A food and beverage holder for mounting onto a generally upright object, comprising:

a center receptacle having an upper end, a lower end, a front side, a back side and a pair of opposing side ends, said upper end having a first opening for receiving one or more food or beverage products in said center receptacle, said lower end having one or more openings therein, each of said side ends having a side receiving component;

a side receptacle having a center insert on a side end thereof, said center insert slidably received in one of said side receiving components of said center receptacle, said side receptacle having an upper end, a lower end, a front side, a back side and a pair of opposing side ends, said upper end having a second opening for receiving one or more food or beverage products in said side receptacle;

a generally vertical base member attached to said back side of said center receptacle;

a clamp member attached to said base member, said clamp member comprising a pair of gripping arms extending rearwardly from said base member; and one or more connectors interconnecting said pair of gripping arms for connecting said food and beverage holder to the object without requiring said one or more connectors to penetrate or alter the object.

13. The holder according to claim 12, wherein an adhesive is used to fixedly attach said center insert of said side receptacle to said side receiving component of said center receptacle.

14. The holder according to claim 12, wherein said center receptacle can slide upward onto said base member.

15. The holder according to claim 14 further comprising a stop member on said base member, said base member configured to stop the further upward movement of said center receptacle.

16. A food and beverage holder for use with stadium seats, comprising:

a center receptacle having an upper end, a lower end, a front side, a back side and a pair of opposing side ends, said upper end having a first opening for receiving one or more food or beverage products in said center receptacle, each of said opposing side ends having a side receiving component thereon;

a side receptacle attached to at least one of said opposing side ends of said center receptacle, said side receptacle having an upper end, a lower end, a front side, a back side and a pair of opposing side ends, said upper end having a second opening for receiving one or more food or beverage products in said side receptacle, one of said side ends of said side receptacle having a center insert thereon, said side receiving component on said center receptacle configured to slidably receive said center insert;

a generally vertical base member attached to said back side of said center receptacle;

a clamp member attached to said base member, said clamp member comprising a pair of gripping arms extending rearwardly from said base member, said clamp member configured to tightly grip a standard used for stadium seats; and one or more connectors interconnecting said pair of gripping arms for connecting said food and beverage holder to said standard without requiring said one or more connectors to penetrate or alter said standard.

17. The holder according to claim 16, wherein said side receptacle is slidably received on one of said side ends of said center receptacle and fixedly attached thereto with an adhesive.

18. A food and beverage holder for mounting onto a generally upright object, comprising:

a receptacle having an upper end, a lower end, a front side, a back side and a pair of opposing side ends, said upper end having a first opening for receiving one or more food or beverage products in said receptacle;

a generally vertical base member attached to said back side of said receptacle, said receptacle configured to slide upward onto said base member;

a clamp member attached to said base member, said clamp member comprising a pair of gripping arms extending rearwardly from said base member; and one or more connectors interconnecting said pair of griping arms for connecting said food and beverage holder to the object without requiring said one or more connectors to penetrate or alter the object.

19. The holder according to claim 18 further comprising a stop member on said base member, said base member configured to stop the further upward movement of said receptacle.

20. The holder according to claim 19 wherein said receptacle is a center receptacle and said holder further comprises a side receptacle attached to at least one of said opposing side ends of said center receptacle, said side receptacle having an upper end, a lower end, a front side, a back side and a pair of opposing side ends, said upper end of said side receptacle having a second opening for receiving one or more food or beverage products in said side receptacle.

21. The holder according to claim 18, wherein said receptacle is a center receptacle and each of said side ends of said center receptacle has a side receiving component configured to slidably receive a center insert located on a side end of a side receptacle, said side receptacle having a second opening for receiving one or more food or beverage products in said side receptacle.

22. The holder according to claim 21, wherein an adhesive is used to fixedly attach said center insert of said side receptacle to said side receiving component of said center receptacle.

* * * * *